US006396450B1

(12) United States Patent
Gilbert

(10) Patent No.: US 6,396,450 B1
(45) Date of Patent: May 28, 2002

(54) PROGRAMMABLE IMAGE ANTENNA

(75) Inventor: Roland Gilbert, Milford, NH (US)

(73) Assignee: BAE Systems Information and Electronic Systems Integration INC, Nashua, NH (US)

( * ) Notice: Subject to any disclaimer, the term of this patent is extended or adjusted under 35 U.S.C. 154(b) by 0 days.

(21) Appl. No.: 09/853,385

(22) Filed: May 11, 2001

Related U.S. Application Data

(60) Provisional application No. 60/203,752, filed on May 12, 2000.

(51) Int. Cl.[7] ..... H01J 40/14

(52) U.S. Cl. ..... 343/756; 250/578; 342/374

(58) Field of Search ..... 343/756, 741, 343/824, 833, 701; 315/34; 250/578; 342/374

(56) References Cited

U.S. PATENT DOCUMENTS

| | | | | |
|---|---|---|---|---|
| 2,691,076 A | 10/1954 | Moore et al. | ..... | 179/171 |
| 3,080,523 A | 3/1963 | Miller | ..... | 325/15 |
| 3,392,393 A | 7/1968 | Spitz | ..... | 343/754 |
| 4,310,843 A | 1/1982 | Yoder | ..... | 343/100 SA |
| 4,399,442 A | 8/1983 | Desantis et al. | ..... | 343/100 SA |
| 4,573,050 A | 2/1986 | Waters | ..... | 343/17.1 R |
| 4,728,805 A | 3/1988 | Dempsey | ..... | 250/578 |
| 5,068,580 A | 11/1991 | Smith et al. | ..... | 315/366 |
| 5,132,694 A | 7/1992 | Sreenivas | ..... | 342/373 |
| 6,175,723 B1 | 1/2001 | Rothwell, III | ..... | 455/63 |

*Primary Examiner*—Don Wong
*Assistant Examiner*—James Clinger
(74) *Attorney, Agent, or Firm*—Scott J. Asmus; Vernon C Maine; Maine & Asmus

(57) ABSTRACT

The present invention provides a programmable image antenna formed on the face plate of a cathode ray tube (CRT) or on another substrate. The inner CRT face is coated with a silicon semiconductor material replacing conventional phosphors utilized in CRTs for generating visual images. An electron beam impinging upon the silicon-coated CRT face plate creates conductive areas during liberation of minority carriers, in the form of electron-hole pairs. Antenna elements having a virtually unlimited variety of shapes and/or sizes can be formed on the CRT face.

21 Claims, 3 Drawing Sheets

PROGRAMMABLE IMAGE ANTENNA

RELATED APPLICATION

This application claims priority from U.S. Provisional Application Serial No. 60/203,752 filed May 12, 2000.

FIELD OF THE INVENTION

The present invention relates to antennas and, more particularly, to antenna elements transiently formed on a substrate by a light or an electron beam.

BACKGROUND OF THE INVENTION

Modem communications technology demands the use of antennas operable in many frequency bands with varying gains, polarizations and radiation patterns. The use of radios which can operate over a very broad spectrum of frequencies has heretofore necessitated the use of multiple, narrow frequency band antennas. Because real estate (i.e., the space required to physically implement an antenna) may be limited in some applications, such as aircraft, satellites etc., antennas capable of operating in two or more contiguous or separated frequency bands have been developed. The term "antenna" in this description applies to single element antennas as well as antenna arrays which may contain several elements. Antenna elements which operate over a very wide frequency band are well known to those skilled in the antenna art. A spiral antenna is typical of such a wideband antenna element. Such elements may be well suited for a single element application, but they cannot be physically placed in a periodic array configuration without overlapping, whereby the spacing between the centroids of the elements is around $\lambda/2$, where $\lambda$ is the wavelength of the highest intended frequency of operation.

In addition, the orientation of conventional antenna elements is predetermined during manufacturing. It is not generally possible to change the orientation of a complex structure such as a spiral antenna from a right-hand circular polarization (RHCP) to a left-hand circular polarization (LHCP) antenna. However, there are some antenna reconfigurations in the prior art used to selectively connect and disconnect antenna components, thereby allowing a physical reconfiguration of the antenna. For example, U.S. Pat. No. 4,728,805 utilizes photonics to combine antenna elements in various forms. The prior art reconfigurable antenna systems suffer from several deficiencies that effect performance and commercialization. For example, if a smoothly curving antenna element, such as a spiral, is required, the edges of the elements remain jagged, affecting the performance of the antenna.

Several other methods are also known to those skilled in the art of antenna design. For example, a technique for putting several individual antenna elements, such as patch antenna elements, in a given area is to overlay or stack them so that the surface of the lower elements behaves as the ground plane for the elements above them. Unfortunately, the higher frequency elements cannot be arrayed close enough to prevent grating lobes when the beam is scanned.

Still another approach is to stack elements made of silicon or other semiconductor material that can become conductive when illuminated with light or electrons. The material is precut into the shape of the antenna element (i.e., dipole, spiral or other shape). In this approach, the array of higher frequency elements is positioned below the low frequency elements to maintain a nearly $\lambda/4$ spacing between the array of elements and the ground plane. When the low frequency elements are in use, the higher frequency elements below them are not illuminated, thereby becoming transparent to RF energy. Similarly, when the high frequency or lower elements are in operation, the lower frequency elements above them are turned off, becoming purely dielectric and transparent. The surface elements, however, never become totally transparent because the semiconductor materials comprise high $\in_x$ dielectric substrates that are not matched to the surrounding composite materials and foams and therefore cause reflections. What is desired is to have the radiators all on one plane.

In U.S. No. Pat. 4,310,843, an electron beam antenna array is depicted, wherein the antenna elements are individually energized by p-n junction devices that are controlled by electron beams from a cathode ray tube device. Although the p-n junctions are within the enclosed structure, the antenna elements connected to the p-n junctions are external to the structure.

Each of the prior art technologies has a limitation in that only preconceived configurations are generally selectable. In other words, even for an antenna system with selectable frequency bands, polarizations, or directional characteristics, only those discrete possibilities designed into the antenna may be selected. The inventive antenna, on the other hand, has no fixed realization, but rather is "drawn or painted" by an electron beam or the like onto the inner surface of the faceplate. This allows for a great range of possible operations, and simple programming changes applied to the inventive antenna can create a multitude of configurations.

SUMMARY OF THE INVENTION

In accordance with the present invention, there is provided a programmable image antenna formed on the face plate of a cathode ray tube. The CRT face is coated with a semiconductor material such as silicon, gallium arsenide, or indium phosphide, instead of the typical phosphors utilized in CRTs for generating a visual image. An electron beam, striking a silicon-coated face plate, creates conductive areas as minority carriers, in the form of electron-hole pairs. The lifetime of the minority carriers may be adjusted by the resistivity of the silicon material. In this manner, antenna elements having a virtually unlimited variety of shapes and/or sizes can be formed on the CRT face. Coupling this technology with MEMS switches or similar technology can produce a reconfigurable antenna system having an unparalleled range of flexibility. RF energy is coupled to the projected elements by means of an RF transmission line and balun connecting directly or capacitively to the computer generated elements or by means of fiber optic lines that connect to optical/RF modulators and demodulators situated behind the screen on which the projected elements are made conductive. In the case of a direct connection, conductive tabs in the form of ohmic contacts are deposited at the feed points in the silicon plate.

Behind the silicon coated screen, inside the cathode ray tube, is a planar grid structure that operates both as a control screen grid for the electronic beams and as the ground plane for the RF elements. More than one grid may be utilized, such as in the form of FSS structures that can act as ground planes situated at $\lambda/4$ at various frequencies.

It is therefore an object of the invention to provide a programmable image antenna system whereby an excitation means such as RF energy or photonics is used to create antenna elements. A further object of the invention is to provide a reconfigurable array antenna system consisting of individually created antenna elements.

Unlike prior art inventions that described reconfigurable antenna elements being formed externally to the system, the antenna elements of the present invention are in an enclosed structure. In addition, the present invention designs the antenna elements directly on the semiconductor material.

It is an additional object of the invention to provide a reconfigurable array antenna system consisting of individually created antenna elements that may be configured as frequency selective surfaces (FSSs) with multiple ground planes.

It is another object of the invention to provide a programmable image antenna system formed on the face of a cathode ray tube (CRT), and wherein the system formed on the face of a CRT can be made selectively absorptive or reflective.

An object of the invention is a programmable image antenna, comprising a substrate adapted for forming an antenna element thereupon, wherein the substrate is in an enclosed structure. There is a coating disposed upon a first surface of the substrate, the coating being conductive in response to impingement of an energy beam that comes from an energy beam source. There is also an energy beam deflection mechanism for deflecting the energy beam in response to externally-generated energy beam deflection signals, thus controlling the beam. Finally, there is a conductive area formed in a selected portion of the coating in response to impingement of the energy beam.

Another object is the programmable image antenna, wherein the substrate comprises the face plate of a cathode ray tube (CRT) and the coating is disposed on the inside of the CRT face plate. In addition, wherein the coating comprises a semiconductor material adapted to release minority carriers comprising electron-hole pairs when impinged by the electron beam, the material comprising one from the group: silicon, gallium arsenide and indium phosphide.

An additional object includes the programmable image antenna, wherein the semiconductor material has a controllable resistivity and the lifetime of the minority carriers is adjusted by controlling the resistivity of the semiconductor material. And, wherein the resistivity is controlled by altering the purity of the semiconductor material.

Yet a further object is the programmable image antenna, wherein the energy beam source comprises one or more electron guns within the CRT and the energy beam comprises an electron beam. The electron guns are configured to work cooperatively to form the antenna elements on the face plate.

Additionally, an object includes the programmable image antenna, further comprising RF energy coupling means operatively connected to the programmable image antenna and adapted for coupling an RF signal to at least one antenna element formed on the CRT face plate. The RF energy coupling means comprises at least one from the group: transmission line and balun. And, the RF coupling means further comprising direct connection conductive tabs deposited at predetermined points on the CRT face plate, wherein the conductive tabs comprise aluminum contacts and the predetermined points comprise feed points, the contacts being plated at the feed points on the coating on the face plate of the CRT.

And a further object is for the programmable image antenna further comprising at least one substantially planar grid structure disposed within the CRT intermediate the electron gun and the face plate. Including at least one of the at least one substantially planar grid structures is configured to serve as a ground plane. Also, the programmable image antenna with at least one planar grid structure disposed approximately in a $\lambda/4$ relationship relative to the face plate at a predetermined operating frequency. Finally, the programmable image antenna, wherein the at least one substantially planar grid structures comprises at least two planar grid structures disposed within the CRT intermediate the electron gun and the CRT face plate, the at least two planar grid structures being configured to form a frequency selective surface.

Yet an additional object is the programmable image antenna, wherein the antenna elements are formed on the substrate in at least one pattern from the group: right-hand spiral, left-hand spiral, bow-tie, horizontally-polarized dipole, vertically-polarized dipole.

An object includes the programmable image antenna wherein the energy beam deflection system comprises a cursor addressable energy beam control system.

An object also includes the programmable image antenna, wherein the antenna elements are maintained on the CRT face by substantially continuously refreshing the conductive areas by the energy beam and the energy beam deflection mechanism.

An object of the invention is a programmable image antenna, comprising a substrate adapted for forming an antenna element thereupon, wherein the substrate is in an enclosed structure. There is a coating disposed upon a first surface of the substrate, the coating being conductive in response to impingement of an energy beam. There is an energy beam source for generating the energy beams, and an energy beam connection mechanism for delivering the energy beam, whereby a conductive area is formed in a selected portion of the coating in response to impingement of the energy beam.

In this embodiment an object is for a programmable image antenna wherein the substrate comprises the face plate of a cathode ray tube (CRT) and the coating is disposed on the inside of the CRT face plate. An object for this embodiment is the programmable image wherein the energy beam source is photonic. In addition, wherein the energy beam connection mechanism is fiber optic. Finally, an object is the programmable image antenna, wherein the coating comprises a photonically activated coating.

BRIEF DESCRIPTION OF THE DRAWINGS

A complete understanding of the present invention may be obtained by reference to the accompanying drawings, when considered in conjunction with the subsequent detailed description, in which.

DESCRIPTION OF THE PREFERRED EMBODIMENT

The present invention features a programmable image antenna formed on the face plate of a cathode ray tube.

Figure 1:
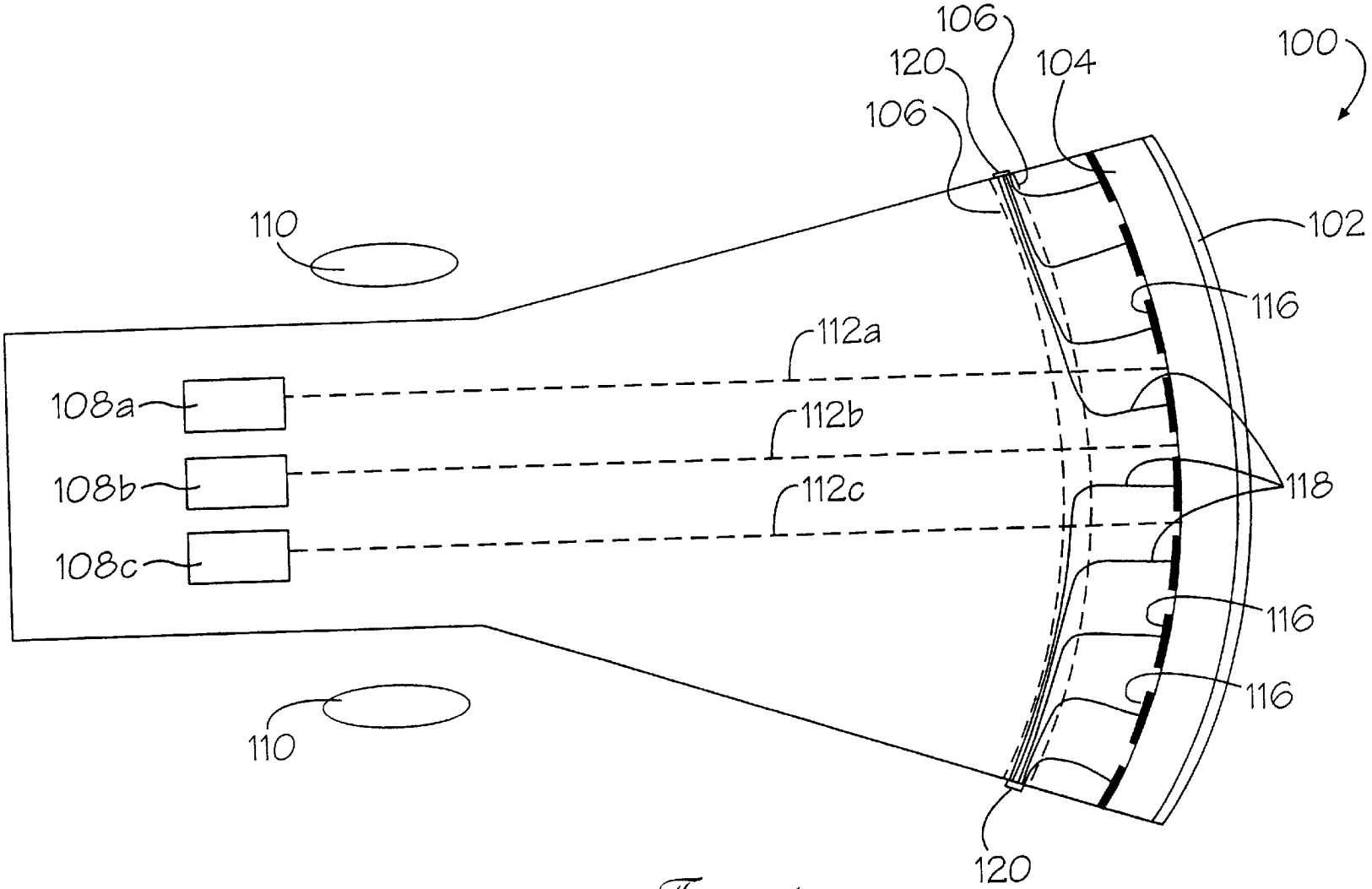
FIG. 1 is a schematic, cross-sectional view of the programmable image antenna system of the invention implemented with a cathode ray tube.
Figure 2B:
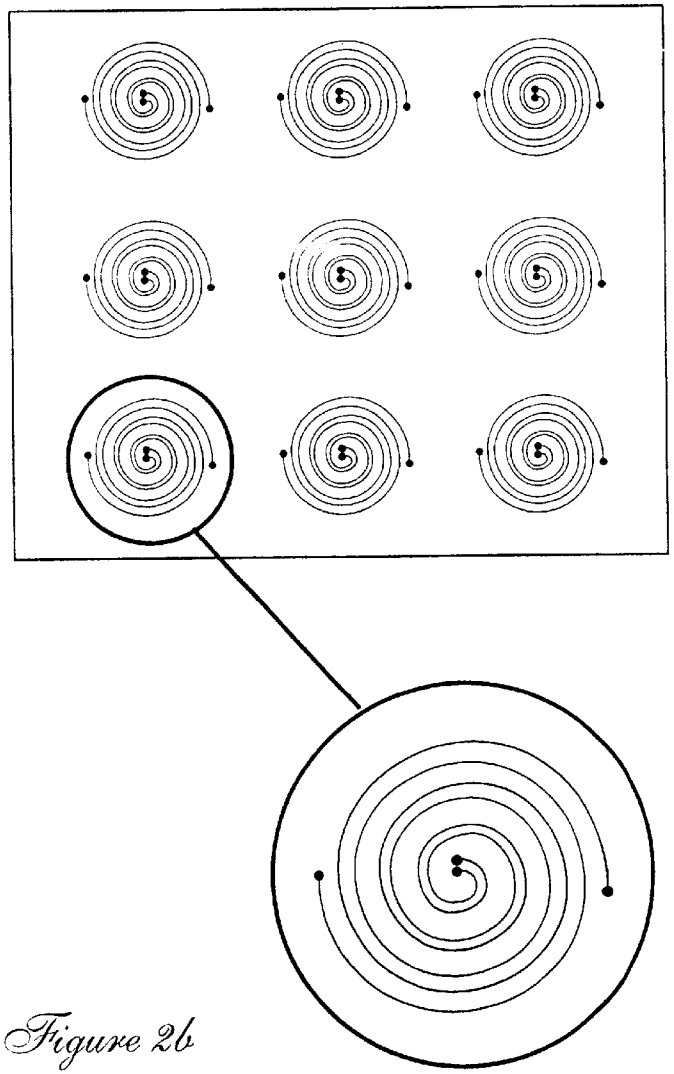
FIG. 2*b* is second front view of the CRT shown in FIG. 1, with a second antenna pattern similar to FIG. 2*a*, except that the spirals generated on the CRT face plate are LHCP.
Figure 2A:
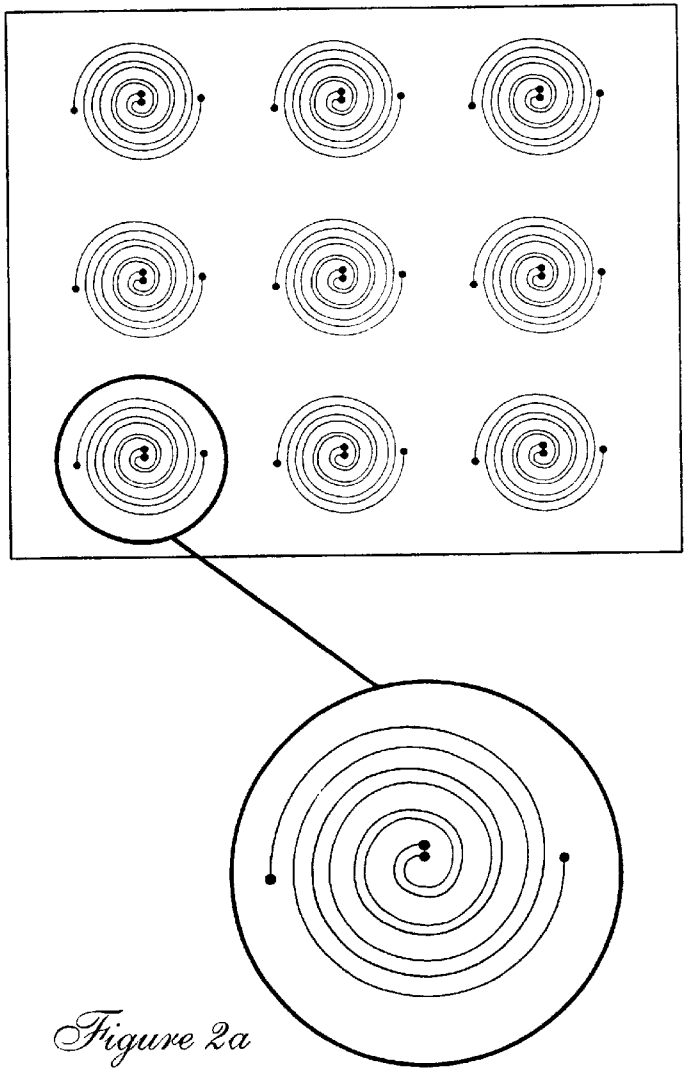
FIG. 2*a* is first front view of the CRT shown in FIG. 1, with a RHCP spiral antenna array pattern generated on the CRT face plate.

Referring first to FIG. 1, there is shown a schematic, cross-sectional view of a CRT, generally at reference number 100. Three electron guns 108*a*, 108*b*, 108*c* are located at the rear of CRT 100. Three electron beams 112*a*, 112*b*, 112*c*, generated by electron guns 108*a*, 108*b*, 108*c*, respectively, are steered by deflection mechanisms shown here as a deflection yoke 110. Any combination of magnetic and/or electrostatic deflection methods well known to those skilled in the CRT art could be used. In particular, electron gun control and the manner of implementation is general knowledge. Electron guns 108*a*, 108*b*, 108*c* each have z axis control capability (i.e., electron beams 112*a*, 112*b*, 112*c* may be turned on and off by electrical signals). The combination of the z-axis control and deflection yoke 110 allows for generation of patterns on CRT 100.

CRT 100 has a face 102 coated with a semiconductor material 104. Amorphous silicon, gallium arsenide and indium phosphide are among the materials known to be suitable for this application. There may well be other materials suitable for use known to those skilled in the art. Semiconductor material 104 forms a screen on the inside of face 102 and replaces light-generating phosphors typically used for visual image production. The semiconductor materials can be applied as a coating or by using vapor or spray-on deposition techniques, as well as other methods familiar to those skilled in the art.

One or more conductive planar grid structures (screens) 106, constructed in a manner similar to a shadow mask or similar component in a conventional CRT, are placed an appropriate distance behind the face plate 102, typically a distance having a $\lambda/4$ relationship to a frequency being transmitted or received by the antenna. Grids 106 operate both as control screen grids for the electron beams 112*a*, 112*b*, 112*c* and as ground planes for the RF elements. Grids 106 may be implemented as frequency selective surface (FSS) structures that can act as ground planes situated at $\lambda/4$ at various frequencies.

In this example, the three electron beams 112*a*, 112*b*, 112*c* are used to "paint" the antenna elements on the semiconductor screen 104. The antenna elements are enclosed within the structure. There is no minimum number of electron guns, and any number that can effectively control the entire surface of the semiconductor material without suffering serious blockage from the grids 106 would be satisfactory. The electron guns 108*a*, 108*b*, 108*c* are positioned in such a way as to assure that all points on the semiconductor screen 104 are accessible to at least one of the electron guns 108*a*, 108*b*, 108*c*. When electron beams 112*a*, 112*b*, 112*c* strike semiconductor screen 104 on CRT face 102, conductive areas, formed as minority carriers (not shown) in the form of electron-hole pairs, are liberated. The lifetime of the minority carriers may be adjusted by selecting the purity of the silicon material of predetermined purity. Lifetimes in the range of approximately 0.01 to 1.0 ms are typical, depending upon the choice of semiconductor material and the amount and manner of doping of the semiconductor RF energy is coupled to the projected elements on screen 104 of CRT 100 by means of RF transmission lines 118 and baluns 116 connecting directly or capacitively to computer generated elements (i.e., conducting regions in the semiconductor material 104). Typical conductive patterns are shown in FIGS. 2*a*, 2*b* and 3*a*–3*d* which are drawn by the system. Conductive tabs (not shown) in the form of ohmic contacts are deposited at the feed points in the semiconductor screen 104 under baluns 116. The process involves doping the silicon and plating aluminum contacts. Persons having skill in semiconductor processes are familiar with depositing ohmic contacts onto silicon. Since oxidation is not a problem inside a low atmosphere CRT, transmission lines 118 could make contact as springs originating from the transmission lines and applying pressure to the ohmic contacts.

The RF transmission lines 118 are grouped and folded out of the way of the electron beams and brought to the sides of CRT connectors or capacitive patches 120. The capacitive patches 120 operate in a manner similar to a cellular antenna connected through the windshield of an automobile: the connection is capacitive and need not penetrate the glass.

In alternate embodiments, RF energy could also be coupled by means of modulated light via fiber optic lines (not shown) that connect to optical/RF modulators and demodulators (not shown) disposed behind the screen 104 on which the projected elements are made conductive.

Figure 3C:
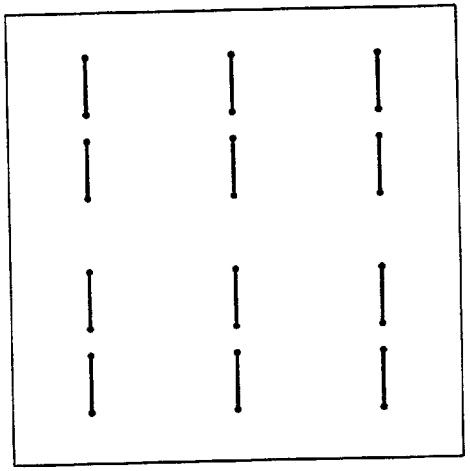
FIG. 3*c* is a front view of the CRT shown in FIG. 1, with an array of vertically-polarized dipoles.
Figure 3D:
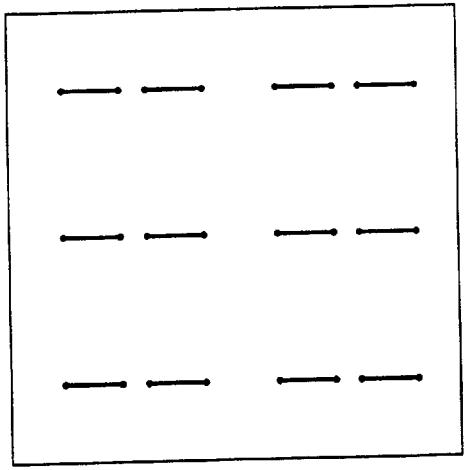
FIG. 3*d* is a front view of the CRT shown in FIG. 1, with an array of horizontally polarized dipoles.
Figure 3A:
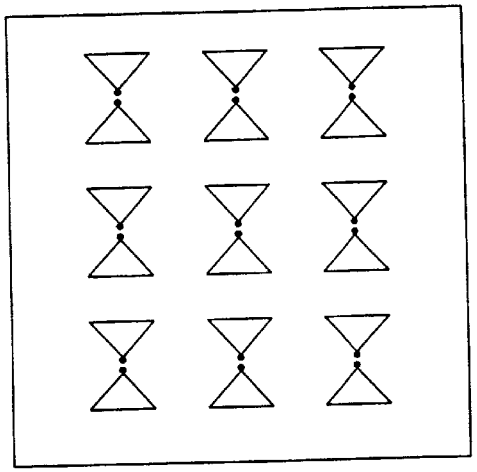
FIG. 3*a* is a front view of the CRT shown in FIG. 1, with a bow tie dipole array pattern.
Figure 3B:
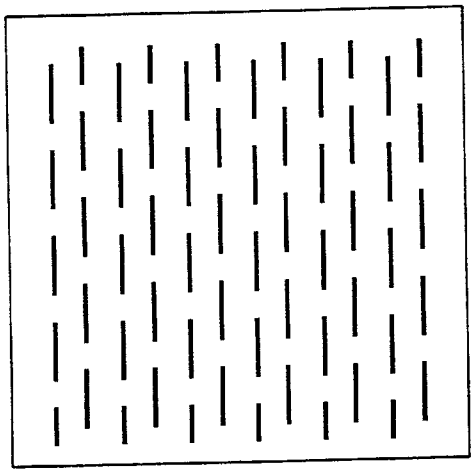
FIG. 3*b* is a front view of the CRT shown in FIG. 1, with a frequency selective surface (FSS) pattern.

Referring now again to FIGS. 2*a* and 2*b*, there are shown right-hand and left-hand, circularly polarized spiral antenna patterns, respectively, formed on face plate 102 by electron beams 112*a*, 112*b*, 112*c*. Referring now also to FIGS. 3*a*, 3*b*, 3*c* and 3*d*, there are shown four additional possible antenna patterns. FIG. 3*a* shows an array of bow-tie elements; FIG. 3*b* a frequency selective surface (FSS) pattern; FIG. 3*c* an array of vertically polarized diodes; and FIG. 3*d* an array of horizontally polarized diodes.

As may be seen, a wide variety of antenna element shapes may readily be formed on face plate 102 merely by changing the deflection of electron beams 112*a*, 112*b*, 112*c*.

One of the many advantages of the inventive programmable antenna is that very smooth antenna curvatures can be achieved, as compared to discrete segments connected together with switches. This allows a high degree of precision in the left-hand and right-hand spiral antenna elements shown in FIGS. 2*a* and 2*b*, respectively. There is no limit to the number of different patterns that may be generated, a limitation being only the resolution of the semiconductor material 104 on the face 102 of CRT 100.

In other embodiments, a substrate other than a CRT face may be coated with a photonically responsive material. A laser or other similar energy source could then be used to selectively activate conductive areas on the substrate. In yet other embodiments, some type of bipolar, switchable materials could be employed so that a particular conductive pattern on the substrate could be maintained, absent the constant refreshing of an electron gun, laser, or the like.

The inventive technique may be used to change antenna characteristics in different ways. A certain antenna configuration could be created for a long period of time by constantly refreshing the screen. When the use of that first configuration was no longer required, an alternate configuration could be "written" to the screen and maintained until a second task was performed using the antenna. Refreshing the screen by utilizing cursor addressable beam control, as occurs with computer screens, allows the system to handle several elements simultaneously. This represents an improvement in flexibility and speed over the raster scan technique of conventional TV sets that operate at 30 Hz.

Another mode of operation is also possible. Because the lifetime of the conductivity of the semiconductor material may be relatively short (i.e., on the order of tenths of milliseconds), the inventive system could be used to switch quickly among several antenna configurations, thereby effectively multiplexing the antenna.

Another useful feature of the inventive system is to make the antenna "disappear" (i.e., become reflective or lossy) by continuously refreshing the entire surface area of the CRT or other substrate. This has obvious advantages in applications where the antenna and the aperture could become radar reflective, for example, when not in actual use.

The features of the present invention could be utilized to change polarization or directionality of the antenna rapidly. If an array of antenna elements is painted, array steering could also be accomplished.

The programmable image concept could also be used to construct a reconfigurable reflective surface behind other antenna elements.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A programmable image antenna, comprising:

an enclosed structure with a face plate and having a substrate affixed to an inner surface of said faceplate, said substrate reconfigurable as one or more antenna elements, wherein said substrate is responsive to impingement of one or more energy beams, and wherein said antenna elements are formed in a selected portion of said substrate in response to impingement of said energy beams;

an energy beam source for generating said energy beams; and an energy beam deflection mechanism for steering said energy beams.

2. The programmable image antenna according to claim 1, wherein said substrate comprises one or more coatings of a semiconductor material adapted to release minority carriers comprising electron-hole pairs when impinged by said energy beams.

3. The programmable image antenna according to claim 2, wherein said coatings are selected from the group comprising: silicon, gallium arsenide and indium phosphide.

4. The programmable image antenna according to claim 2, wherein said semiconductor material has a controllable resistivity and a lifetime of said minority carriers is adjusted by controlling said resistivity of said semiconductor material.

5. The programmable image antenna as according to claim 4, wherein said resistivity is controlled by adjusting purity of said semiconductor material.

6. The programmable image antenna according to claim 1, wherein said energy beam source comprises one or more electron guns, said enclosed structure is evacuated, said energy beam comprises one or more electron beams, and said electron guns are controlled by said deflection mechanism to paint said antenna elements on said substrate.

7. The programmable image antenna according to claim 1, further comprising:

a radio frequency (RF) energy coupling means operatively connected to said substrate for coupling one or more RF signals to at least one of said antenna elements.

8. The programmable image antenna according to claim 7, wherein said RF energy coupling means comprises transmission lines, baluns and conductive tabs, connecting said antenna elements to said RF signals.

9. The programmable image antenna as recited in claim 8, further comprising microelectromechanical switches (MEMS) connected to said conductive tabs for switchably connecting said RF signals to said antenna elements.

10. The programmable image antenna according to claim 7, wherein said RF energy coupling means comprises one or more optic signals, wherein fiber optic lines, modulators and demodulators operatively connect said antenna elements to said optic signals.

11. The programmable image antenna according to claim 6, further comprising one or more planar grid structures disposed within said structure, substantially parallel to said face plate and intermediate said electron guns and said substrate.

12. The programmable image antenna according to claim 11, wherein at least one of said planar grid structures is a ground plane.

13. The programmable image antenna according to claim 11, wherein said at least one of said planar grid structures is disposed approximately in a $\lambda/4$ relationship relative to said substrate and at a predetermined operating frequency.

14. The programmable image antenna according to claim 11, wherein said at least one of said planar grid structures comprises at least two planar grid structures disposed within said structure intermediate said electron gun and said substrate, said at least two planar grid structures being configured as a frequency selective surface.

15. The programmable image antenna according to claim 1, wherein said antenna elements are formed on said substrate in at least one pattern selected from the group consisting of: right-hand spiral, left-hand spiral, bow-tie, horizontally-polarized dipole, and vertically-polarized dipole.

16. The programmable image antenna according to claim 1, wherein said energy beam deflection system comprises a cursor addressable energy beam control system.

17. The programmable image antenna according to claim 1, wherein said energy beams are substantially continuously refreshing said antenna elements.

18. The programmable image antenna according to claim 1, wherein said substrate is a bipolar switchable material.

19. An programmable image antenna, comprising:

a structure having a photonic responsive substrate reconfigurable as one or more antenna elements, wherein said photonic responsive substrate is responsive to impingement of one or more energy beams;

one or more sources for generating said energy beams;

a means for steering said energy beams to paint said antenna elements; and a radio frequency (RF) energy coupling means operatively connected to said photonic responsive substrate for coupling one or more RF signals to at least one of said antenna elements.

20. The programmable image antenna according to claim 19, wherein said RF energy coupling means comprises one or more optic signals, wherein fiber optic lines, modulators and demodulators operatively connect said antenna elements to said optic signals.

21. The programmable image antenna according to claim 19, wherein said means for steering is a cursor addressable energy beam control system.

* * * * *